US005221804A

United States Patent [19]

Shibukawa

[11] Patent Number: 5,221,804

[45] Date of Patent: Jun. 22, 1993

[54] TONE GENERATION DEVICE FOR AN ELECTRONIC MUSICAL INSTRUMENT

[75] Inventor: Takeo Shibukawa, Hamamatsu, Japan

[73] Assignee: Yamaha Corporation, Hamamatsu, Japan

[21] Appl. No.: 618,475

[22] Filed: Nov. 27, 1990

[30] Foreign Application Priority Data

Nov. 28, 1989 [JP] Japan ..... 1-306421

[51] Int. Cl.[5] ..... G10H 1/053; G10H 1/18

[52] U.S. Cl. ..... 84/658; 84/DIG. 26; 84/626; 84/687

[58] Field of Search ..... 84/DIG. 26, DIG. 27, 84/626, 630, 658, 687, 707, DIG. 1, 622, 659, 662, 692

[56] References Cited

U.S. PATENT DOCUMENTS 4,195,545 4/1980 Nishimoto ..... 84/627
4,476,763 10/1984 Uya et al. ..... 84/609
4,622,878 11/1986 Sharp ..... 84/DIG. 27
4,875,400 10/1989 Okuda et al. ..... 84/658

FOREIGN PATENT DOCUMENTS 60-147793 8/1985 Japan .
62-200398 9/1987 Japan .

*Primary Examiner*—William M. Shoop, Jr.
*Assistant Examiner*—Helen Kim
*Attorney, Agent, or Firm*—Spensley Horn Jubas & Lubitz

[57] ABSTRACT

A tone generation device for an electronic musical instrument capable of producing multiple tone source effects such as a stereophonic effect and a reverberation effect includes a plurality of tone forming circuits, a control parameter generation circuit for generating control parameter for controlling outputs of the tone forming circuits, a plurality of tone synthesizing circuits for synthesizing outputs of some of the tone forming circuits and outputs of others of the tone forming circuits together in accordance with the control parameters supplied from thge control parameter generation circuit, and sound systems provided in correspondence to the respective tone synthesizing circuits.

12 Claims, 8 Drawing Sheets

TONE GENERATION DEVICE FOR AN ELECTRONIC MUSICAL INSTRUMENT

BACKGROUND OF THE INVENTION

This invention relates to a tone generation device for an electronic musical instrument and, more particularly, to a tone generation device for an electronic musical instrument capable of producing multiple tone source effects such as a stereophonic effect and a reverberation effect.

For producing a stereophonic effect in an electronic musical instrument, it is necessary to prepare tone sources respectively for left and right channels. According to a prior art system, for example, a stereophonic system is composed, as shown in FIG. 3, by providing a left channel tone source section and a right channel tone source section independently from each other and connecting sound systems respectively to these tone sources.

In the prior art system shown in FIG. 3, two tone sources which produce tones corresponding to strong and weak key touches are provided in each of the left and right channel tone source sections, and outputs of these two tone sources are added together by addition means to form a left channel tone source and a right channel tone source. Thirty-two tones are used for each tone source, so that, in the case of an electronic musical instrument employing a waveform memory storing tone waveforms of a tone source, it is necessary to store waveform data of $32\times2=64$ as waveforms corresponding to the strong touch tones and weak touch tones of the thirty-two tones and, since these waveforms must be prepared for both the left and right channels, it is ultimately necessary for the waveform memory to store $64\times2=128$ waveform data.

In addition to this problem of generating and storing a large number of waveforms, there arises difficulty in matching phases of the left and right channel tone waveforms with a resulting discrepancy in the produced tone image.

It is, therefore, an object of the invention to provide a tone generation device for an electronic musical instrument capable of producing multiple tone source effects such as a stereophonic effect and reverberation effect without generating and storing a large number of waveforms.

SUMMARY OF THE DISCLOSURE

A tone generation device for an electronic musical instrument achieving the above described object of the invention comprises, as shown in the schematic diagram of FIG. 1, a plurality of tone forming means (G0, G1, G2, . . . Gn), control parameter generation means (P) for generating control parameters for controlling outputs of said tone forming means, a plurality of tone synthesizing means (C1, C2, . . . Cn) for synthesizing outputs of some, corresponding to sound systems, of said tone forming means and outputs of others of said tone forming means together in accordance with the control parameters supplied from said control parameter generation means, and said sound systems (S1, S2, . . . Sn) provided in correspondence to the respective tone synthesizing means.

According to an embodiment of the invention, outputs of some of the tone forming means are synthesized with outputs of others of the tone forming means by the tone synthesizing means in accordance with control parameters supplied from the control parameter generation means and the synthesized tone signals are supplied to the corresponding sound systems to be sounded as tones therefrom.

FIG. 2 shows a relationship of synthesizing ratio of touch strength P (P') to Q (Q') in a case, for example, where outputs P and P' of the first and second tone forming means G1 and G2 are synthesized with parameter controlled outputs Q and Q' of the tone forming means G0. Generally speaking, the outputs P, P' of the tone forming means G1, G2 are tones which are desired to excercise a greater effect to a multiple tone source effect such as a stereophonic effect, for example, weak or low tones, whereas the output of the tone forming means G0 is a tone which is desired to excercise a smaller effect to the multiple tone source effect, for example a strong or high tone. The outputs of the tone forming means however are not limited to the above in a case where a special multiple tone source effect is desired.

The control parameters supplied from the control parameter generation means P to the tone synthesizing means C1, C2, . . . Cn may be first selected from a parameter table established to form a synthesizing ratio as shown in FIG. 2 on the basis of values corresponding to tone pitches, channels etc. or values set by operating an operation switch or the like, and then may be determined from among the selected parameters in accordance with the touch strength.

If a reverberation effect is to be obtained, five tone forming means, four tone synthesizing means and four sound systems, for example, are prepared. Four among the five tone forming means are connected respectively to corresponding tone synthesizing means and output of the remaining one tone forming means is distributed to the four tone synthesizing means and synthesized with outputs of the other tone forming means in accordance with suitable control parameters.

Preferred embodiments of the invention will be described below with reference to the accompanying drawings.

BRIEF DESCRIPTION OF THE DRAWINGS

In the accompanying drawings.

DESCRIPTION OF PREFERRED EMBODIMENTS

Figure 1:
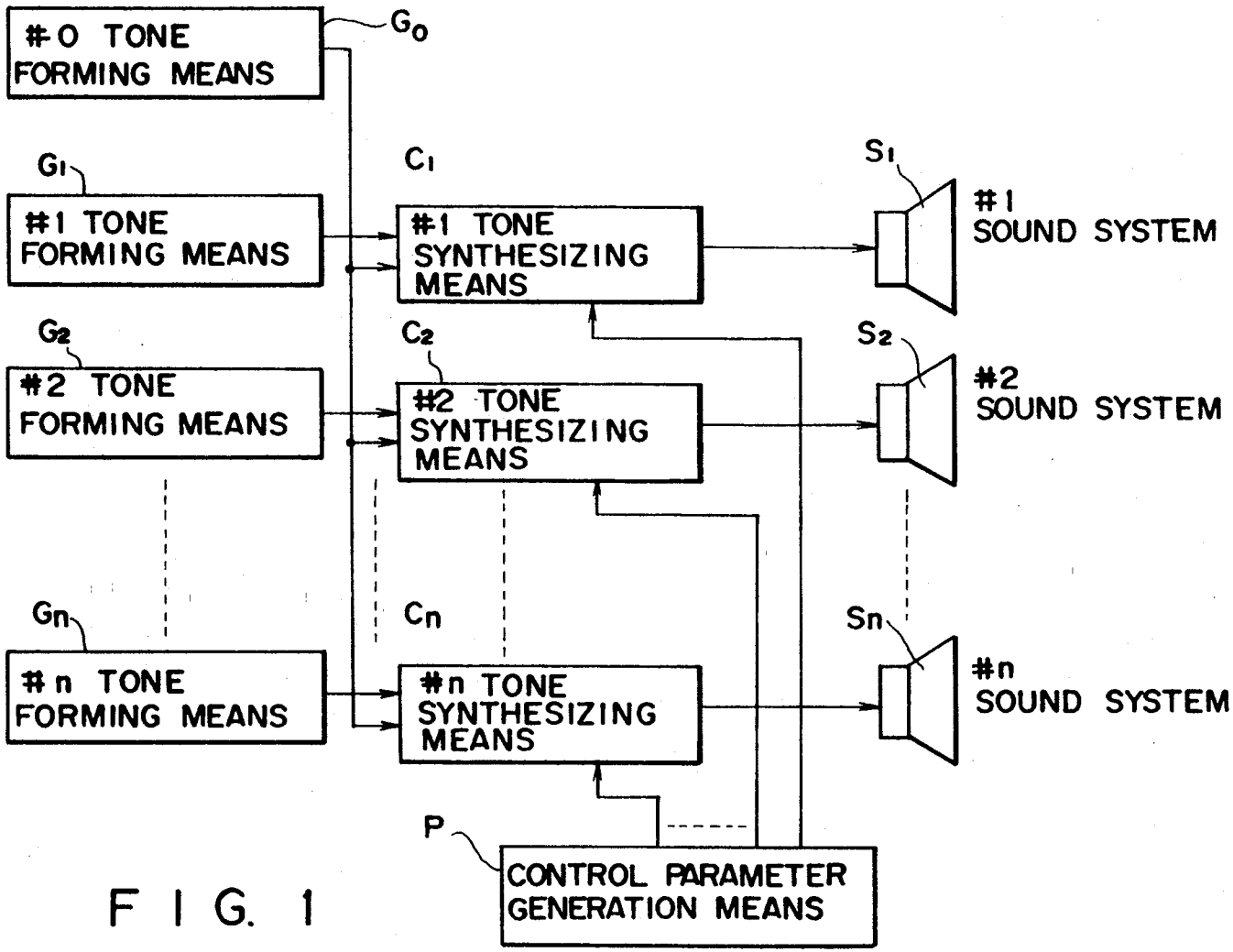
FIG. 1 is a block diagram schematically showing the principal construction of a tone generation device according an embodiment of the invention.
Figure 2:
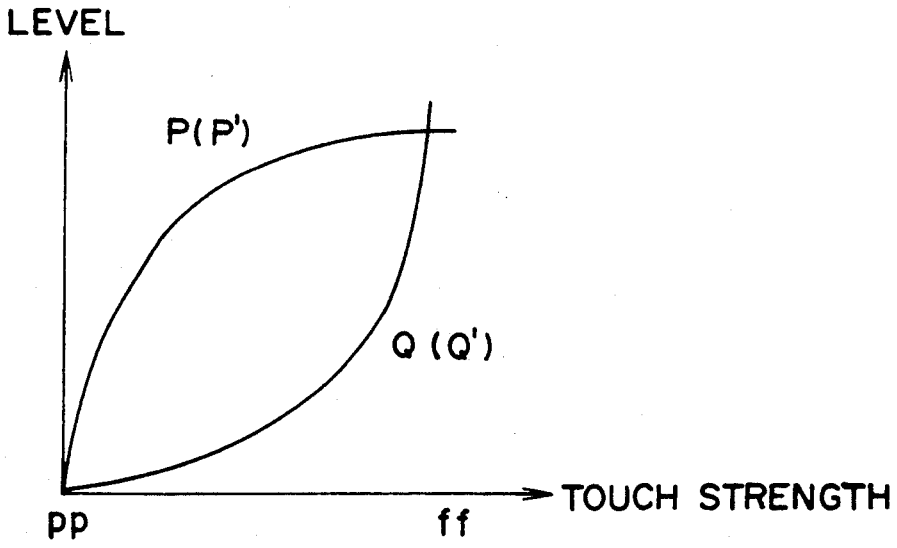
FIG. 2 is a disgram showing an example of tone synthesis according to an embodiment of the invention.
Figure 3:
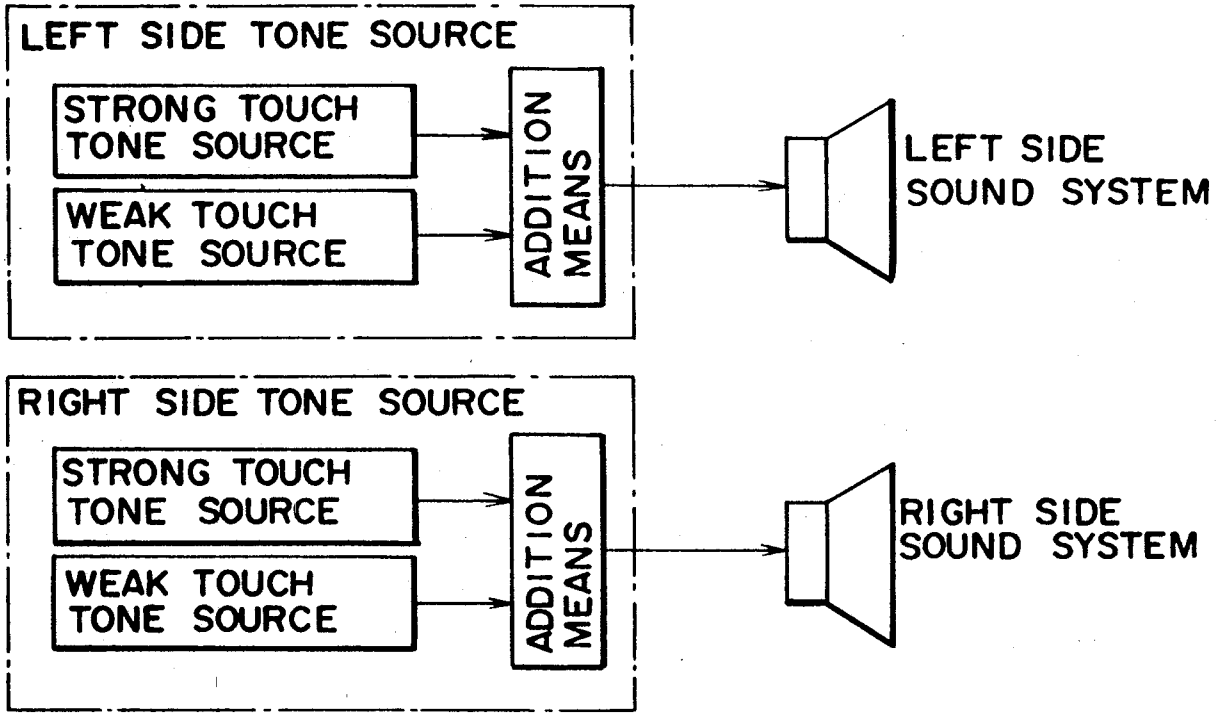
FIG. 3 PRIOR ART
FIG. 3 is a block diagram showing a prior art tone generation device.
Figure 4:
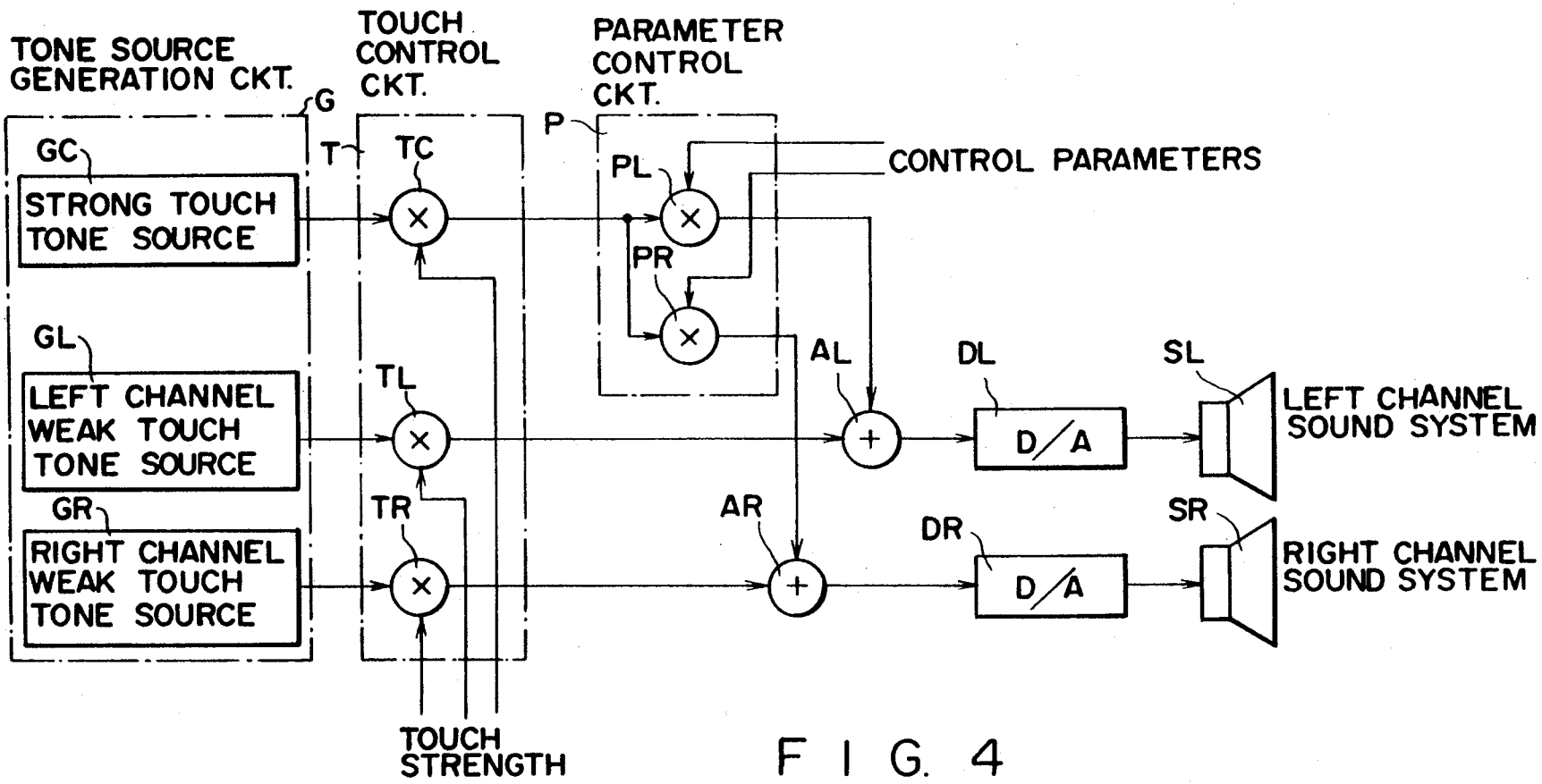
FIG. 4 is a block diagram schematically showing a preferred embodiment of the invention.

FIG. 4 shows schematically an embodiment of the invention which has been applied to an electronic musical instrument which generates a tone by a digital processing using a waveform memory for storing tone waveform data.

A tone source generation circuit G comprises three tone sources, namely a strong touch tone source GC which generates a tone signal when a key has been depressed with a strong key touch, and a left channel weak touch tone source GL and a right channel weak touch tone source GR which respectively generate a tone signal when a key has been depressed with a weak key touch. Tone signals for tones having tone pitches corresponding to depressed keys in a keyboard are generated from these tone sources GC, GL and GR. Outputs of these tone sources GC, GL and GR are supplied to a touch control circuit T and multiplied with values corresponding to touch strength in multiplication circuits TC, TL and TR of the touch control circuit T.

The tone signal from the strong touch tone source GC which has been subjected to the touch control by the multiplication circuit TC is supplied to a parameter control circuit P. The parameter control circuit P comprises a left channel multiplication circuit PL and a right channel multiplication circuit PR respectively for multiplying the tone signal from the strong touch tone source GC with control parameters. The output of the left channel multiplication circuit PL of the parameter control circuit P and the output of the left channel multiplication circuit TL of the touch control circuit T are added together by an addition circuit AL. The result of addition is converted to an analog signal by a digital-to-analog converter DL and supplied to a left channel sound system SL to be sounded as a left channel tone therefrom. Likewise, the output of the right channel multiplication circuit PR of the parameter control circuit P and the output of the right channel multiplication circuit TR of the touch control circuit T are added together by an addition circuit AR. The result of addition is converted to an analog signal by a digital-to-analog converter DR and supplied to a right channel sound system SR to be sounded as a right channel tone therefrom.

Figure 5A:
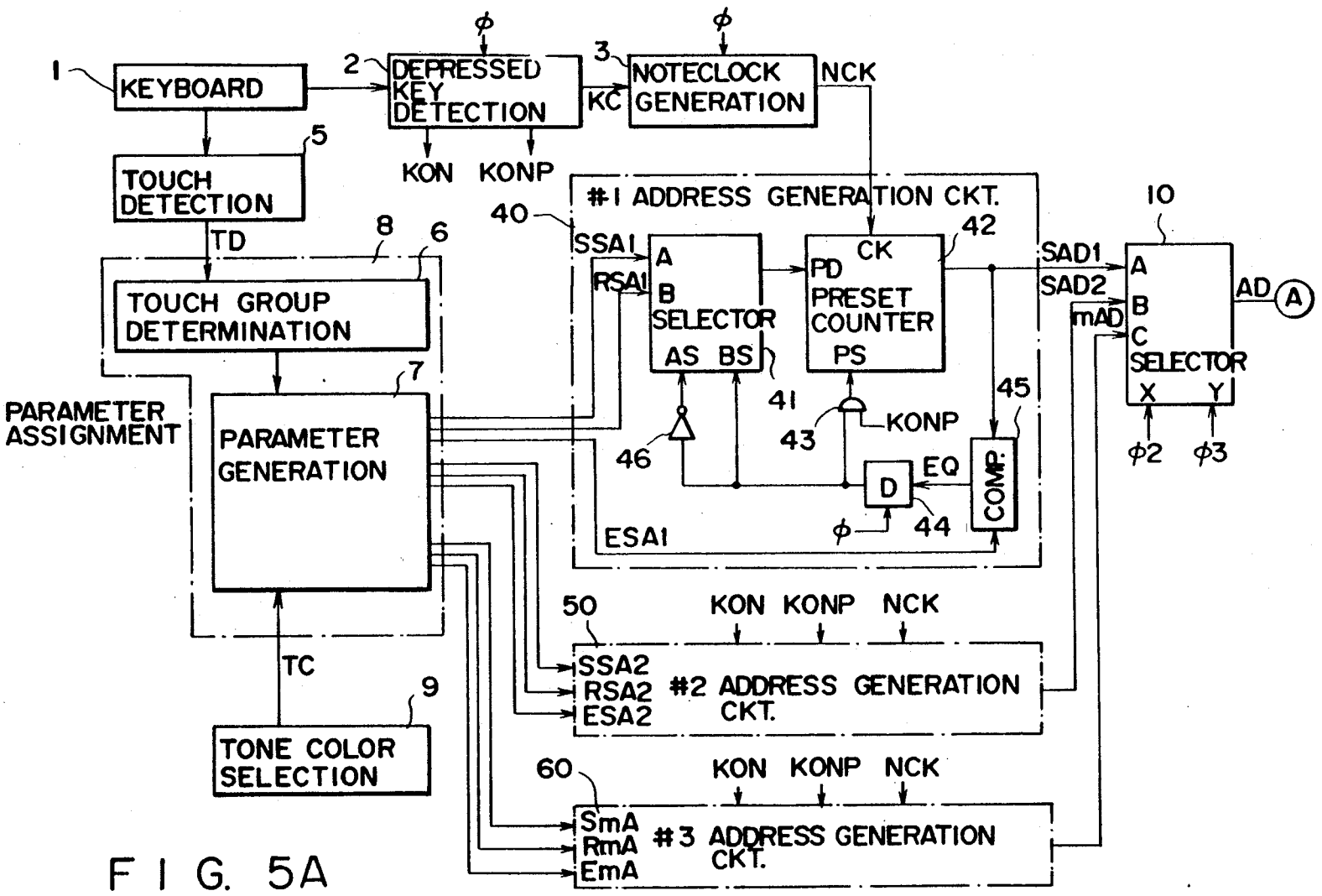
FIGS. 5A and 5B are block diagrams showing a specific embodiment of the invention.
Figure 5B:
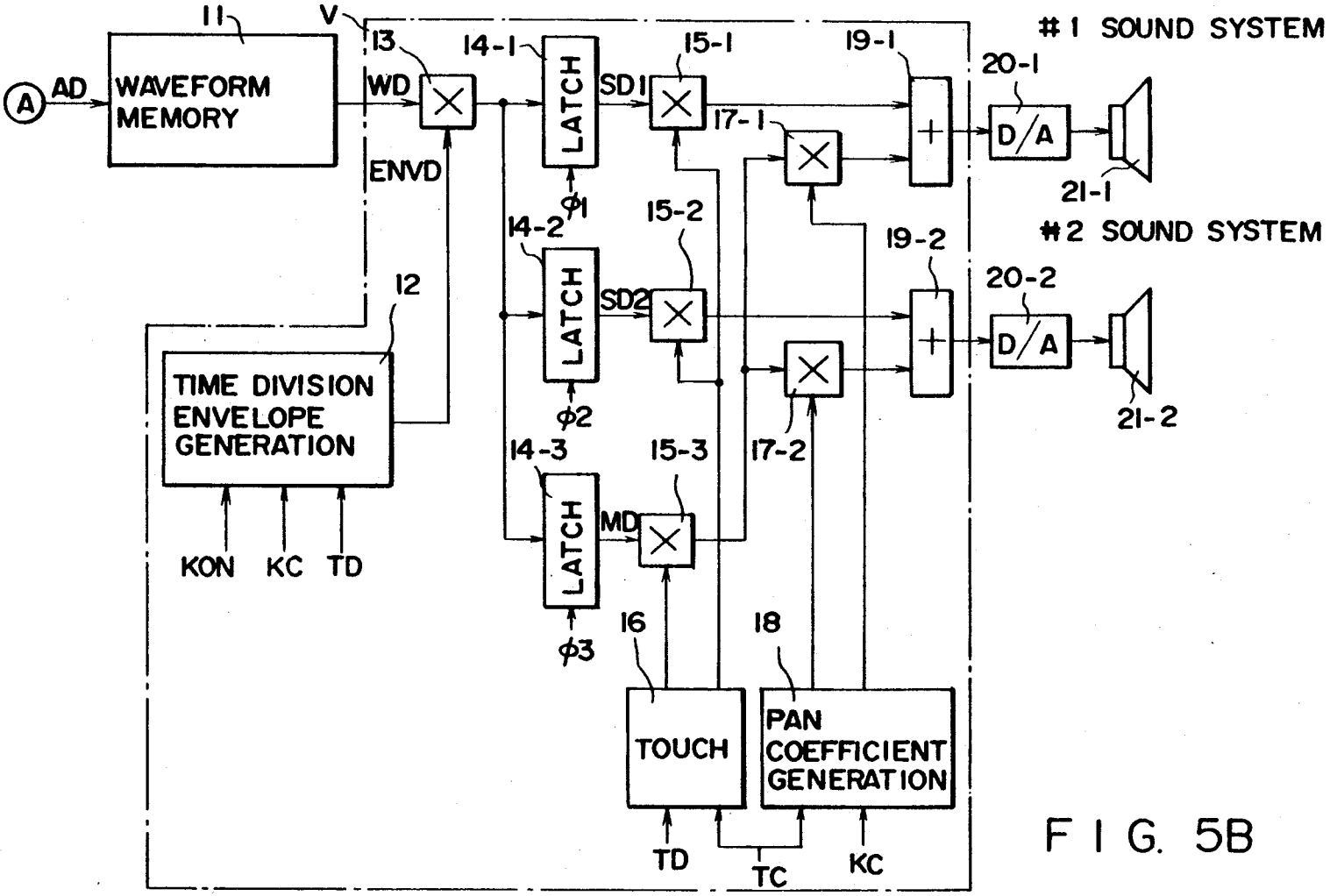

FIGS. 5A and 5B show a specific embodiment of the invention which is incorporated in the monophonic type electronic musical instrument disclosed in the same assignee's Japanese Patent Application Laid-open No. 62-200398 entitled "Tone signal generation device". This embodiment will be described with reference also to the timing chart of FIG. 6.

A depressed key detection circuit 2 detects a key which has been depressed in a keyboard 1 and provides a key code KC identifying the depressed key, a key-on signal KON which maintains a state "1" while the key is being depressed and a key-on pulse KONP which is temporarily generated as a pulse which rises to "1" at the initial stage of depression of the key. Since the electronic musical instrument to which this embodiment has been applied is a single tone generation type instrument, when plural keys have been depressed simultaneously, the signals KC, KON and KONP are generated with respect to a single depressed key chosen in accordance with a predetermined preference order. Output timings of these signals KC, KON and KONP are synchronized with a clock pulse $\phi$ shown in FIG. 6(*a*).

A note clock generation circuit 3 generates, in response to the given key code KC, a note clock pulse NCK having a frequency corresponding to the tone pitch of the depressed key. This note clock pulse NCK is applied to a No. 1 address signal generation circuit 40 of No. 1 channel corresponding to a left channel, a No. 2 address signal generation circuit 50 of No. 2 channel corresponding to a right channel, and a No. 3 address signal generation circuit 60 which is common to the No. 1 and No. 2 channels for supplying a tone signal to the left and right channels. These address signal generation circuits 40, 50 and 60 have the same construction.

Since these address signal generation circuits 40, 50 and 60 have the same construction, the internal construction of the No. 1 address signal generation circuit 40 only is illustrated.

A touch detection circuit 5 detects the key touch strength of the key depressed in the keyboard 1 on the basis of the speed of depression, depressing force or the like and provides touch data TD representing the key touch strength of the depressed key. This touch data TD is supplied to a touch group determination circuit 6 which classifies the touch data TD into one of two groups A and B in accordance with the key touch strength.

The following Table 1 shows an example of a tone color control table which is stored in a parameter generation circuit 7 to which the touch group data A or B indicating whether the key touch is strong or weak is supplied.

TABLE 1

| Input 1 | Tone color 1 | | ... | Tone color n |
|---|---|---|---|---|
| | Input 2 | | | |
| | Touch group | | | |
| | strong← | →weak | | |
| Output | A | B | | A B |
| SSA1 | SA of mf | SA of mf | | |
| RSA1 | RA of mf | RA of mf | ... | ... |
| ESA 1 | EA of mf | EA of mf | | |
| SSA2 | SA of mf | SA of mf | | |
| RSA2 | RA of mf | RA of mf | ... | ... |
| ESA2 | EA of mf | EA of mf | | |
| SmA | SA of ff | SA of p | | |
| RmA | RA of ff | RA of p | ... | ... |
| EmA | EA of ff | EA of p | | |

In this Table 1, the input 1 in the first line represents the type of tone color selected from among N types of tone colors ranging from tone color 1 to tone color N designated in response to a tone color selection code TC supplied from a tone color selection circuit 9. In the table, it is assumed that the tone color 1 has now been selected. The Input 2 in the second line of the table represents the touch group data A or B supplied from the touch group determination circuit 23. The group A represents a strong touch and the group B represents a weak touch.

Among output names listed in the left column of the Table, SSA1, RSA1 and ESA1 represent addresses of waveform data stored in a waveform memory 11 to be described later which are supplied to the No. 1 address generation circuit 40, SSA2, RSA2 and ESA2 represent data which are supplied to the No. 2 address generation circuit 50 and SmA, RmA and EmA represent data which are supplied to the No. 3 address generation circuit 60. SA represents start address data. RA repeat address data and EA end address data, respectively, and waveform data corresponding to the key touch strengths ff, mf and p are stored in storage areas in the waveform memory 11 designated by the above described addresses.

A specific example in Table 1 will be explained. If the key touch is strong and the touch data TD therefore belongs to the strong touch group A when the tone color 1 has been selected by the tone color selection circuit 9, the waveform address data SSA1, RSA1 and ESA1 corresponding to mezzoforte mf are produced as waveform characteristic parameters of the No. 1 address generation circuit 40, the waveform address data SSA2, RSA2 and ESA2 corresponding to mezzoforte mf are produced as waveform characteristic parameters of the No. 2 address generation circuit 50 and the waveform address data SmA, RmA and EmA correspondig to fortessimo ff are produced as waveform characteristic parameters of the No. 3 address generation circuit 60.

If the key touch is weak and the touch data TD therefore belongs to the weak touch group B, the waveform address data SSA1, RSA1 and ESA1 corresponding to mezzoforte mf are produced as waveform characteristic parameters of the No. 1 address generation circuit 40, the waveform address data SSA2, RSA2 and ESA2 corresponding to mezzoforte are produced as waveform characteristic parameters of the No. 2 address generation circuit 50 and the waveform address data SmA, RmA and EmA corresponding to pianissimo p are produced as waveform characteristic parameters of the No. 3 address generation circuit 60.

As to the other tone colors selected by the tone color selection circuit 9, as shown in Table 1, respective address data corresponding to the touch groups A and B are stored in the same manner as in the case of the above described tone color 1.

The operation of the address generation circuit 40 having the above described internal construction will now be described. The operations of the other address generation circuits 50 and 60 is the same as that of the address generation circuit 40. For convenience of explanation, a selector 10 which is connected to output side of these address generation circuits 40, 50 and 60 is assumed to supply constantly outputs of the address generation circuit 40 as read address of the waveform memory 11.

The start address data SSA1 and read address data RSA1 are applied to input terminals A and B of a selector 41 and output of this selector 41 is applied to a preset data input terminal PD of a preset counter 42.

When no key has been depressed, an output signal of a delay flip-flop 44 is "0" and the selector 41 selects and outputs the start address data SSA1 applied to the input terminal A.

When any key in the keyboard 1 has been depressed, the key-on pulse KONP which is generated in the initial stage of key depression is applied to a preset terminal PS of the preset counter 42 through an OR gate 43 and this causes the start address data SSA1 to be preset in the preset counter 42 in synchronism with application of the note clock pulse NCK. Simultaneously, the note clock generation circuit 3 starts generation of the note clock pulse NCK having a repeating period corresponding to the frequency of tone pitch of the depressed key and this note clock pulse NCK is applied to a counting clock input terminal CK of the preset counter 42.

The preset counter 42 thereby starts counting of the note clock pulse NCK, counting the start address data SSA1 as initial value, so that the address SAD1 supplied to the input terminal A of the selector 10 gradually increments at a rate corresponding to the tone pitch of the depressed key starting with the address data SSA1 as the initial value. When this address SAD1 has assumed the same value as the end address data ESA1, a comparator 45 produces a signal "1".

The selector 41 selects the repeat address data RSA1 from the input terminal B in response to this signal "1" from the comparator 45. This signal "1" is supplied also to the preset input terminal PS of the preset counter 42 through the OR gate 43 and, accordingly, the repeat address RSA1 is preset in the preset counter 42 in synchronism with arrival of next note clock pulse NCK.

The preset counter 42 thereby resumes incrementing corresponding to the note clock pulse NCK from the preset repeat address RSA1 and returns to the repeat address RSA1 and repeats incrementing each time the count of the preset counter 42 has reached the value equal to the end address data ESA1.

By this repeating operation, a waveform from the start address SSA1 to the end address ESA1 is read once from the waveform memory 11 and then waveform from the repeat address RSA1 to the end address ESA1 is repeatedly read from the waveform memory 11.

Summing up, the parameter generation circuit 7 provides the read start address SSA1, repeat address RSA and read end address ESA1 for the waveform memory 11 which are determined by the tone color selected by the tone color selection circuit 9 and the key touch strength, and the preset counter 42 supplies to the input side of the selector 10 the gradually incrementing address from the read start address SSA1 to the read end address ESA1 of the waveform memory 11 and then the gradually incrementing address from the repeat address RSA1 to the read end address ESA1 repeatedly.

Figure 6:
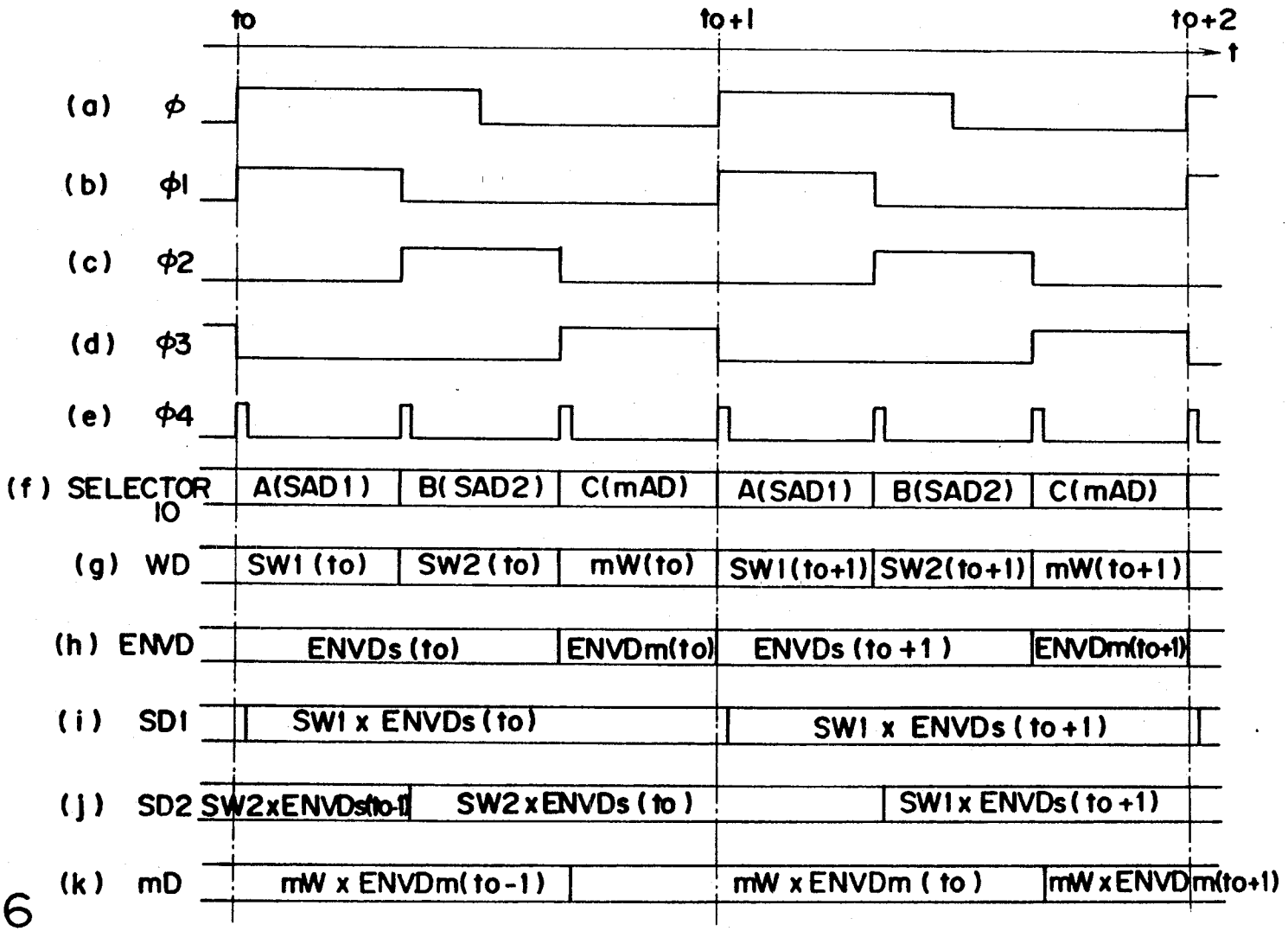
FIG. 6 is a timing chart for explaining operation of the embodiment of FIGS. 5A and 5B.

Accordingly, the above described addresses from the No. 1 to No. 3 address generation circuits 40, 50 and 60 are supplied to the three input terminals on the input side of the selector 10, so that when the selector 10 performs selection as shown in the following Table 2 in response to values of clocks $\phi 2$ and $\phi 3$ shown in FIGS. 6(*c*) and 6(*d*), output as shown in FIG. 6(*f*) can be obtained from the output terminal of the selector 10.

TABLE 2

| | | Output | |
|---|---|---|---|
| $\phi$ 2 | $\phi$ 3 | Input terminal | Address |
| 0 | 0 | A | SAD1 |
| 1 | 0 | B | SAD2 |
| 0 | 1 | C | mAD |

Tone waveform data is read from the waveform memory 11 by the address shown in FIG. 6(*f*). This tone waveform data WD is shown in FIG. 6(*g*). In this figure, SW1 and SW2 represent tone waveform data of the first system and the second system and mAD represents tone waveform data of the common channel added to tone signals of the first and second systems. (to) and (to+1) represent tone waveform data which are obtained at the addresses at time points starting from time points to and to +1.

In storing tone waveforms in the waveform memory 11, waveform data from rising of the tone to a sustain portion thereof for different tone colors of N types from the tone color 1 to tone color N and for different key touch strengths, e.g., four types of ff, mf (left and right channels) and p, are respectively normalized to a constant amplitude and thereafter are coded according to a suitable coding system such as the pulse code modulation (PCM) and stored in storage areas assigned thereto. An envelope of a tone generated from read out tone waveform data is controlled later by an envelope control circuit.

The address at which data of the first sample point of the attack portion is stored constitutes the above described start address SA, the address at which data of the last sample point of the waveform is stored constitutes the end address EA and the head address of the sustain portion constitutes the repeat address RA.

Waveform data WD read from the waveform memory 11 is multiplied by a multiplier 13 with envelope data ENVD (FIG. 6(*h*)) supplied from a time division envelope generation circuit 12 for imparting the tone to be produced with en envelope. In a latch circuit 14-1 of the No. 1 channel is latched SW1×ENVDs when the clock $\phi$1 is "1" and in a latch circuit 14-2 of the No. 2 channel is latched SW2×ENVDs when the clock $\phi$2 is "1". In a latch circuit 14-3 of the common channel is latched mW×ENVDm when the clock $\phi$3 is "1".

Tone data SD1, SD2 and MD shown in FIGS. 6(*i*), 6(*j*) and 6(*k*) are read from the latch circuits 14-1, 14-2 and 14-3 at timings shown in the figure synchronized with the clocks $\phi$1, $\phi$2 and $\phi$3. For increasing the weight of a weak touch waveform when the touch is weak and increasing the weight of a strong touch waveform when the touch is strong, a touch weight generation circuit 16 generates touch weight data in response to the touch data TD and the tone color control data TC. The tone data SD1, SD2 and MD are multiplied with the touch weight data in multipliers 15-1, 15-2 and 15-3.

As to the tone data MD of the common channel supplied from the latch circuit 14-3, this tone data MD is multiplied with a PAN coefficient from a PAN coefficient generation circuit 18 in multipliers 17-1 and 17-2 in order to produce a low tone from the channel corresponding to the left hand side of the performer and a high tone from the channel corresponding to the right hand side of the performer on the basis of the key code and thereby create a stereophonic effect.

The output of the multiplier 17-1 is added to the tone data of the No. 1 channel by an adder 19-1 and the output of the multiplier 17-2 is added to the tone data of the No. 2 channel by an adder 19-2. The resulting data are respectively converted to analog tone signals by digital-to-analog converters 20-1 and 20-2 and then supplied to sound systems 21-1 and 21-2 of the No. 1 and No. 2 channels to be sounded as tones therefrom.

The envelope data from the time division envelope generation circuit 12, the touch weight data from the touch weight generation circuit 16 and the PAN coefficient from the PAN coefficient generation circuit 18 are suitably determined depending upon what kind of acoustic effect or multiple tone source effect is to be produced, so that description of details of these data will be omitted.

Figure 7:
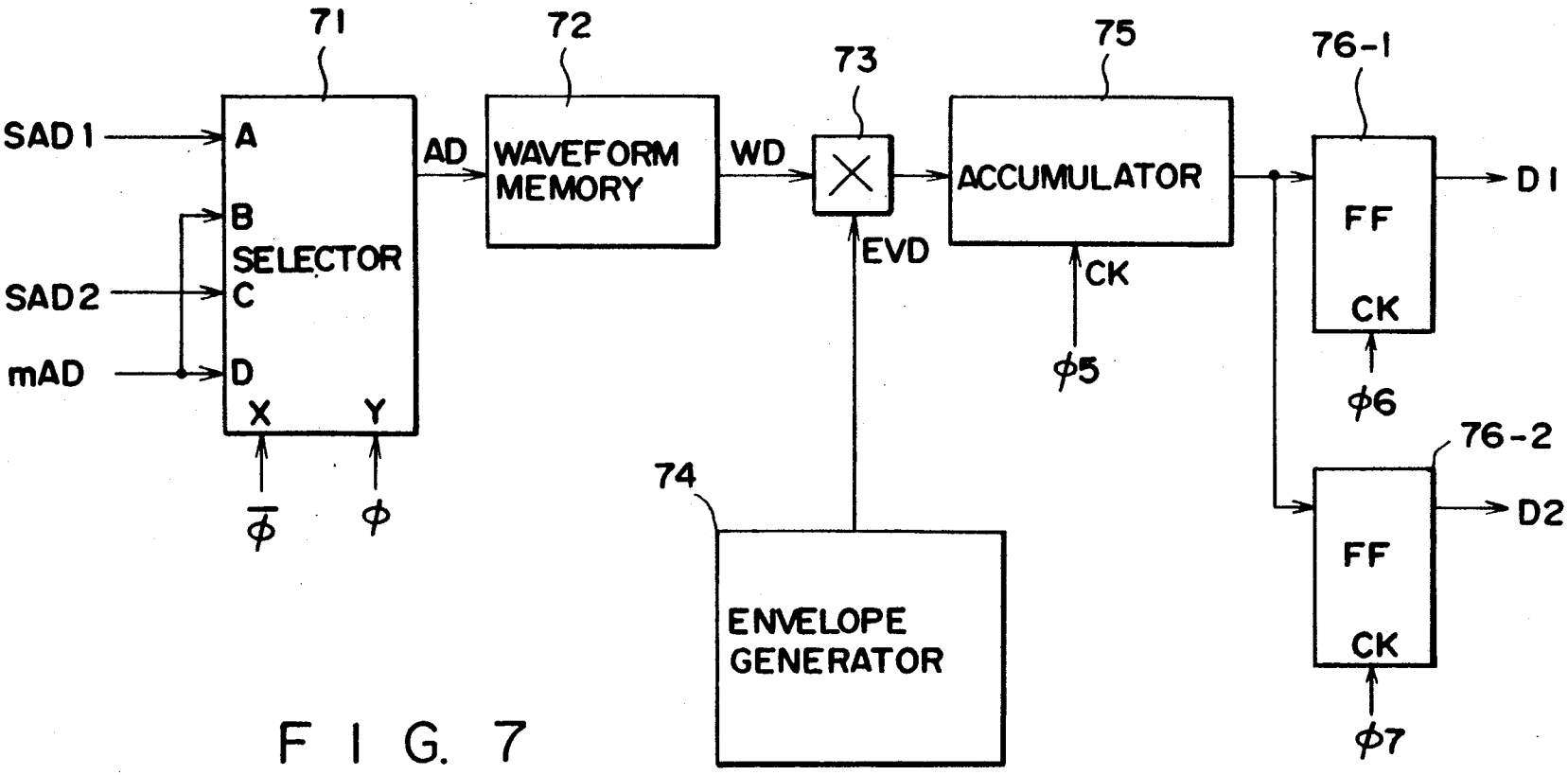
FIG. 7 is a block diagram showing another embodiment of the invention which is a partial modification of the embodiment of FIGS. 5A and 5B.

FIG. 7 shows another embodiment of the invention which is a modification of the portion designated by reference character V in FIG. 5B.

In FIG. 7, a selector 71 produces, as shown in the following Table 3, address data AD in the order of SAD1, mAD, SAD2, mAD, SAD1 . . . by switching inputs from input terminals A, B, C and D in response to clocks $\overline{\phi}$5 and $\phi$.

TABLE 3

| | | Output | |
|---|---|---|---|
| | | Input terminal | Address |
| 0 | 0 | A | SAD1 |
| 1 | 0 | B | mAD |
| 0 | 1 | C | SAD2 |
| 1 | 1 | D | mAD |

When the clock $\overline{\phi}$5 and the clock $\phi$ are both "0", tone data of the No. 1 channel is read from a waveform memory 72 by the address SAD1 applied to an input terminal A. Then, upon turning of the clock $\overline{\phi}$5 to "1", tone data of the common channel is read from the waveform memory 72 by the address mAD applied to an input B.

Tone data WD which has been continuously read out in this manner by the addresses SAD1 and mAD is multiplied with envelope data EVD from an envelope generator 74 in a multiplier 73 and the result of multiplication is supplied to an accumulator 75. In the accumulator 75, therefore, the tone data of the No. 1 channel and the tone data of the common channel are added together and the result of addition is latched by a flip-flop 76-1 at rising of a clock $\phi$6.

The envelope data EVD is data which includes the envelope data ENVD from the time division envelope generation circuit 12, touch weight data from the touch weight generation circuit 16 and the PAN coefficient from the PAN coefficient generation circuit 18 of the embodiment of FIG. 5. The envelope data EVD is suitably determined depending upon what kind of acoustic effect of multiple tone source effect is to be produced, so that description of details of the envelope data EVD will be omitted.

The accumulator 75 is cleared at falling of next clock 5, i.e., rising of clock $\phi$5. Since the clock is turned to "1" also at this time, the selector 71 supplies the address SAD2 applied to the input terminal C to the waveform memory 72 as address data AD and, therefore, tone data of the No. 2 channel which has been multiplied with the envelope data EVD is supplied to the accumulator 75 which has been cleard.

Then, upon rising of the clock $\phi$5 to "1", the waveform memory 72 is accessed by the address mAD which is applied to the input terminal D of the selector 71 and tone data of the common channel has been which is multiplied with the envelope data EVD in the multiplier 73 is supplied to the accumulator 75 and the result of addition is latched by a flip-flop 76-2 upon rising of a clock $\phi$7.

Accordingly, tone data which is a result of addition of the tone data of the No. 1 channel and the tone data of the common channel is latched by the flip-flop 76-1 and the tone data which is a result of addition of the tone data of the No. 2 channel and the tone data of the common channel is latched in the flip-flop 76-2. By converting the tone data latched by the flip-flops 76-1 and 76-2 to analog data and supplying the analog data to the sound systems, a multiple tone source effect such as a stereophonic effect can be obtained in the same manner as in the previously described embodiment.

In the above description, a tone corresponding to a strong or weak key touch is supplied to the No. 1 and No. 2 channels and sounded as a monaural output and a tone corresponding to a key touch of an intermediate order is distributed to the No. 1 and No. 2 channels and sounded as a stereophonic output. Conversely, a tone corresponding to a strong or weak key touch may be synthesized as a stereophonic sound and a tone corresponding to a key touch of an intermediate order may be synthesized as a monaural sound.

In a case where a stereophonic effect is to be obtained in the performance of a keyboard instrument such as piano, it is possible to produce a sound from a channel corresponding to the left hand side of the performer if the depressed key is one in the low tone range and produce a sound from a channel corresponding to the right hand side if the depressed key is one in the high tone range.

The waveform data stored in the waveform memory is not limited to data which has been normalized in its envelope level but it may be data including envelope information such as attack and decay. In this case, the envelope shape signal from the envelope generator maintains a constant level during depression of the key and exhibits a release envelope characteristic upon release of the key.

The waveform stored in the waveform memory may be a full waveform from the start of sounding of the tone to the end thereof instead of the above described repeatedly read out partial waveform. The waveform may also be a waveform of plural periods, one period or half period. Further, waveform information at all sample points of a waveform need not necessarily be stored but waveform information at skipped sample points may be stored and waveform information at intermediate sample points may be computed by an interpolation operation.

In a case where a waveform of plural periods is stored, the waveform is not limited to one of continuous plural periods but may be one which, as disclosed in Japanese Patent Application Laid-open No. 60-147793, is obtained by dividing a waveform from rising of a tone to falling thereof into plural frames, storing only waveform data of one or two periods which is representative of each frame, and reading out these waveform data sequentially and repeatedly. In this case, smoothly changing waveform data may be obtained by performing an interpolation operation before switching of the waveform data on the basis of preceding waveform data and succeeding waveform data.

If one waveform data is stored as complete data in the waveform memory and difference between this complete data and other waveform data is stored as representing the other waveform, data amount stored will be saved.

As to the coding system of the waveform data stored in the waveform memory, coding systems other than the above described PCM system, e.g., difference PCM (DPCM), adaptive PCM (ADPCM), delta modulation (DM), ADM and LPC, may be employed.

In the above described embodiment, waveform data corresponding to the three types of key touch strength, i.e., ff, mf and p, are stored in the waveform memory. Alternatively, waveform data corresponding to four or more types of key touch strength, e.g., ff, mf, mp and pp, may be stored in the waveform memory.

The system for generating a tone signal in each channel is not limited to the above described waveform memory reading system but it may be one of other systems such as a harmonics synthesis system, an FM modulation system and an AM modulation system. In a case where a system other than the waveform memory reading system is used, parameters generated by the parameter assignment circuit will be ones corresponding to the employed system.

In the above described embodiment, the address for reading out a waveform is formed by counting the note clock pulse. Alternatively, the address may be formed by accumulating or adding or subtracting frequency numbers corresponding to the tone pitch of a tone of a depressed key. Further, in the above described embodiment, the address generation circuit is provided in each channel but a common hardware circuit may be used on a time shared basis for generating addresses or, alternatively, these addresses may be generated by performing a software processing using a microprocessor.

The above described embodiment has been described as being incorporated in an electronic musical instrument of a type producing a single tone at a time but it is possible to generate plural tones simultaneously by employing a time division processing.

Further, the synthesizing ratio of outputs of plural tone forming means may be changed with lapse of time.

What is claimed is:

1. A tone generation device for an electronic musical instrument comprising:

a plurality of tone forming means $G_o$–$G_n$ for forming tone signals respectively, the plurality of tone forming means dividing into tone forming means $G_o$–$G_{k-1}$ and tone forming means $G_k$–$G_n$ where k and n are natural numbers;

control parameter generation means for generating control parameters for controlling tone signals of the tone forming means $G_o$–$G_n$;

a plurality of tone synthesizing means, respectively coupled to the tone forming means $G_k$–$G_n$, for each synthesizing a tone signal of the coupled one of the tone forming means $G_k$–$G_n$ and at least one tone signal of the tone forming means $G_o$–$G_{k-1}$ in accordance with the control parameters supplied from the control parameter generation means; and a plurality of sound systems, respectively coupled to the plurality of tone synthesizing means, for respectively generating musical tones based on the synthesized results of the plurality of tone synthesizing means.

2. A tone generation device as defined in claim 1 wherein k is one.

3. A tone generation device as defined in claim 1 wherein said tone forming means $G_o$–$G_n$ comprise:

a plurality of tone source generation means corresponding to plural types of key touch strengths; and touch control means for multiplying outputs of said tone source generation means with values corresponding to said plural types of key touch strengths, and said tone synthesizing means comprise:

parameter control means for controlling tone signals of the tone forming means $G_o$–$G_{k-1}$ in accordance with the control parameters supplied from said control parameter generation means; and addition means for adding tone signals of the tone forming means $G_k$–$G_n$ with outputs of said parameter control means.

4. A tone generation device as defined in claim 3 wherein, said plural tone source generation means comprise strong touch tone source generation means, left channel weak touch tone source generation means and right channel weak touch tone source generation means;

said parameter control means comprises multiplication circuits for left and right channels for multiplying output of said strong touch tone source generation means with the control parameters to form right and left channel strong touch tone signals; and said addition means comprise an addition circuit for the left channel for adding the output of said left channel weak touch tone source generation means and the left channel strong touch tone signal from said left channel multiplication circuit and an addition circuit for the right channel for adding the output of said right channel weak touch tone source generation means and the right channel strong touch tone signal from said right channel multiplication circuit.

5. A tone generation device as defined in claim 3 wherein, said plural tone source generation means comprise weak touch tone source generation means, left channel strong touch tone source generation means for generating a left channel strong touch tone signal and right channel strong touch tone source generation means for generating a right channel strong touch tone signal;

said parameter control means comprises multiplication circuits for left and right channels for multiplying output of said weak touch tone source generation means with the control parameters to form right and left channel weak touch tone signals; and said addition means comprise an addition circuit for the left channel for adding the output of said left channel strong touch tone source generation means and the left channel weak touch tone signal from said left channel multiplication circuit and an addition circuit for the right channel for adding the output of said right channel strong touch tone source generation means and the right channel weak touch tone signal from said right channel multiplication circuit.

6. A tone generation device for an electronic musical instrument comprising:

a plurality of first tone forming means, each first tone forming means for forming first tone signals;

at least one second tone forming means, each second tone forming means for forming second tone signals, wherein the number of second tone forming means is less than the number of first tone forming means;

control parameter generation means for generating control parameters for controlling tone signals of the first and second tone forming means;

a plurality of tone synthesizing means, each tone synthesizing means being coupled to a respective first tone forming means, each tone synthesizing means for synthesizing the first tone signal of the first tone forming means coupled thereto and the second tone signal of the second tone forming means in accordance with the control parameters supplied from the control parameter generation means; and a plurality of sound systems, each sound system coupled to a respective one of the plurality of tone synthesizing means, for generating musical tones based on the synthesized results of the plurality of tone synthesizing means.

7. A tone generation device for an electronic musical instrument comprising:

a plurality of first tone forming means, each first tone forming means for forming first tone signals;

no more than one second tone forming means, each second tone forming means for forming second tone signals;

control parameter generation means for generating control parameters for controlling tone signals of the first and second tone forming means;

a plurality of tone synthesizing means, each tone synthesizing means being coupled to a respective first tone forming means, each tone synthesizing means for synthesizing the first tone signal of the first tone forming means coupled thereto and the second tone signal of the second tone forming means in accordance with the control parameters supplied from the control parameter generation means; and a plurality of sound systems, each sound system coupled to a respective one of the plurality of tone synthesizing means, for generating musical tones based on the synthesized results of the plurality of tone synthesizing means.

8. A tone generation device for an electronic musical instrument comprising:

a plurality of first tone source generation means and at least one second tone source generation means, each of the first and second tone source generation means corresponding to one of plural types of key touch strengths, each first and second tone source generation means for forming respective tone output signals;

touch control means for multiplying respective output signals of said first and second tone source generation means with values corresponding to said plural types of key touch strengths to provide a multiplied output corresponding to each output signal of the first and second tone source generation means;

control parameter generation means for supplying control parameters;

parameter control means for controlling the multiplied output corresponding to the tone output signals of the at least one second tone source generation means in accordance with the control parameters supplied from said control parameter generation means to provide a plurality of parameter control means output signals; and a plurality of addition means for adding the multiplied output corresponding to the tone output signals of each of the first tone source generation means with a respective parameter control means output signal to provide an addition output corresponding to each multiplied output; and a plurality of sound systems, each sound system coupled to a respective one of the plurality of addition means for generating musical tones based on the addition output of the addition means coupled thereto.

9. A tone generation device as defined in claim 8 wherein, said plural tone source generation means comprise strong touch tone source generation means, left channel weak touch tone source generation means and right channel weak touch tone source generation means;

said parameter control means comprises multiplication circuits for left and right channels for multiplying output of said strong touch tone source generation means with the control parameters to form right and left channel strong touch tone signals; and said addition means comprise an addition circuit for the left channel for adding the output of said left channel weak touch tone source generation means and the left channel strong touch tone signal from said left channel multiplication circuit and an addition circuit for the right channel for adding the output of said right channel weak touch tone source generation means and the right channel strong touch tone signal from said right channel multiplication circuit.

10. A tone generation device as defined in claim 8 wherein, said plural tone source generation means comprise weak touch tone source generation means, left channel strong touch tone source generation means for generating a left channel strong touch tone signal and right channel strong touch tone source generation means for generating a right channel strong touch tone signal;

said parameters control means comprises multiplication circuits for left and right channels for multiplying output of said weak touch tone source generation means with the control parameters to form right and left channel weak touch tone signals; and said addition means comprise an addition circuit for the left channel for adding the output of said left channel strong touch tone source generation means and the left channel weak touch tone signal from said left channel multiplication circuit and an addition circuit for the right channel for adding the output of said right channel strong touch tone source generation means and the right channel weak touch tone signal from said right channel multiplication circuit.

11. A tone generation device for an electronic musical instrument comprising:

inputting means for inputting performance data designating start timing and intensity of a musical tone to be generated;

a plurality of tone forming means $G_o$–$G_n$ for forming tone signals respectively in response to said performance data, the plurality of tone forming mans dividing into tone forming means $G_o$–$G_{k-1}$ and tone forming means $G_k$–$G_n$ where k and n are natural numbers;

control data generation means for generating control data for controlling tone signals of the tone forming means $G_o$–$G_n$, the control data corresponding to said intensity designated by said performance data;

a plurality of tone synthesizing means, respectively coupled to the tone forming means $G_k$–$G_n$, for each synthesizing a tone signal of the coupled one of the tone forming means $G_k$–$G_n$ and at least one tone signal of the tone forming means $G_o$–$G_{k-1}$ in accordance with the control data supplied from the control data generation means; and a plurality of sound systems, respectively coupled to the plurality of tone synthesizing means, for respectively generating musical tones based on the synthesized results of the plurality of tone synthesizing means.

12. A tone generation device as defined in claim 11 wherein said intensity designated by said performance data is touch strength.

* * * * *